United States Patent [19]

Novak et al.

[11] 4,375,867

[45] Mar. 8, 1983

[54] ELECTRIC FASTENER DRIVING TOOL

[75] Inventors: Raymond F. Novak, Itasca; Richard Doyle, Mt. Prospect, both of Ill.

[73] Assignee: Duo-Fast Corporation, Franklin Park, Ill.

[21] Appl. No.: 148,365

[22] Filed: May 9, 1980

Related U.S. Application Data

[63] Continuation of Ser. No. 921,978, Jul. 5, 1978, abandoned.

[51] Int. Cl.[3] ..... B25C 1/06

[52] U.S. Cl. ..... 227/109; 227/131

[58] Field of Search ..... 227/8, 109, 120, 131, 227/136, 156

[56] References Cited

U.S. PATENT DOCUMENTS

| | | | |
|---|---|---|---|
| 2,716,749 | 9/1955 | Timmerbeil | 227/109 |
| 3,004,260 | 10/1961 | Van Den Elzen | 227/120 |
| 3,022,509 | 2/1962 | De Man | 227/109 |
| 3,172,124 | 3/1965 | Kremiller | 227/8 |
| 3,330,462 | 7/1967 | Colechia et al. | 227/109 |
| 3,360,176 | 12/1967 | Gehl et al. | 227/156 X |
| 3,464,614 | 9/1969 | Volkmann | 227/8 X |
| 3,661,312 | 5/1972 | Pomernacki | 227/136 X |
| 3,713,573 | 1/1973 | Fehrs | 227/8 |
| 4,005,812 | 2/1977 | Doyle | 227/131 |
| 4,136,810 | 1/1979 | Bull | 227/120 |

FOREIGN PATENT DOCUMENTS

| | | | |
|---|---|---|---|
| 260493 | 9/1931 | Italy | 227/109 |

*Primary Examiner*—Paul A. Bell

*Attorney, Agent, or Firm*—Mason, Kolehmainen, Rathburn & Wyss

[57] ABSTRACT

An electric nailer includes a body and a fastener magazine pivotally connected thereto. The nailer also includes a switch for energizing the nailer that is engagable by a safety to prevent actuation. The safety is moved out of engagement with the switch upon pivoting of the magazine. The magazine includes a pusher assembly defined in part by portions of an elongated tube joined together to define a gap. A pusher is slideably mounted within the gap and biased to push fasteners toward the nose of the nailer. The magazine also includes a fastener track that includes a reduced portion and an enlarged portion to accommodate fasteners of different sizes. A shoe may be releasably attached to the bottom portion of the magazine and in one embodiment is V-shaped including a raised portion at one end. In another embodiment the shoe has a flat workpiece engagement portion.

17 Claims, 20 Drawing Figures

ELECTRIC FASTENER DRIVING TOOL

This application is a continuation of application Ser. No. 921,978, filed July 5, 1978 and now abandoned.

BACKGROUND OF THE INVENTION

A. Field of the Invention

The present invention relates to improvements in electric fasteners driving tools.

B. Description of the Prior Art

Electric tools for driving fasteners such as brads, staples and the like are well known and widely used. Examples of tools of this character developed in the past may be found in U.S. Pat. Nos. 3,141,171; 3,172,121; 3,179,866; 3,434,026; and 4,005,812. All assigned to the assignee of the present application. Such tools commonly include a housing with a handle portion and a head portion. The head portion contains a solenoid winding for accelerating an armature. Typically, a control circuit for energizing the winding is operated by a switch in the handle portion. A magazine is carried by the base of the head portion and by the handle for introducing fasteners into a drive track to be driven by a driver blade supported by the armature.

The present invention relates to improvements in electric fastener driving tools of this type. Among the important objects of the present invention are to provide a tool that is light in weight, is easily and economically manufactured and includes a member that may be used to allow the tool to drive fasteners into the grooves of a grooved workpiece or a flat workpiece and to vary the depth into which the fasteners are driven.

Another object of the present invention is to provide a new and improved electric fastener driving fastener tool including a novel safety that prevents energization of the tool until the tool engages the workpiece.

A further object of the present invention is to provide an electric fastener tool with a pusher assembly including a bifurcated tube defining a gap within which the pusher is mounted with a spring biasing the pusher towards the drive track of the tool. The fasteners are positioned within the gap and between the two portions of the tube.

An additional object of the present invention is to provide a new and improved magazine assembly that is pivotally mounted to the housing of the tool and includes a fastener's track that may support and guide fasteners of different sizes.

Another object of the present invention is to provide a new and improved shoe removably secured to the bottom of the magazine structure of the tool to enable the tool to be used for workpieces that are either grooved or flat and also to allow variation of depth to which the fastener is driven into the workpiece.

The present invention is directed to a new improved electric fastener nailer for driving fasteners into a workpiece and, in particular, into grooved workpieces and also for driving fasteners into different levels in the workpiece. The electric fastener driver of the present invention includes a body defining a head portion and a handle portion. The body is of a clam shell configuration formed of two similar plastic body parts including integral walls forming a solenoid chamber in the head portion and forming a mounting position for a switch and related circuitry in the handle portion. A magazine for supplying fasteners to be driven is pivotally supported on the handle portion. A driver is secured to the solenoid for reciprocation in a drive track defined by the nose portion. Energization of the solenoid and thus of the tool is controlled by a switch that is manually actuated through the employment of a plunger reciprocally mounted in the handle portion.

The tool includes a safety that prevents depression of the plunger until the tool has been placed against the workpiece. The safety is actuated to release the plunger by the pivoting movement of the magazine assembly upon engagement of the tool with the workpiece. More specifically, upon engagement of the tool with the workpiece, the magazine assembly is pivoted from a first position to a second position. The safety is coupled to the magazine assembly and thus moves from a first to a second position in conjunction with the pivoting movement of the magazine assembly. In the second position, the safety is out of engagement with the plunger allowing actuation. The magazine assembly also includes a track that supports and guides fasteners of different sizes.

A pusher assembly for advancing fasteners to the drive track of the tool is included in the magazine assembly. The pusher assembly is defined by a bifurcated, elongated tube defining a gap within which the fasteners are positioned. A pusher is slideably mounted within the gap and biased toward the drive track of the tool by a spring.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 20 is an enlarged exploded view of the nose assembly of the tool of the present invention.

DETAILED DESCRIPTION OF THE PREFERRED EMBODIMENT

Figure 1:
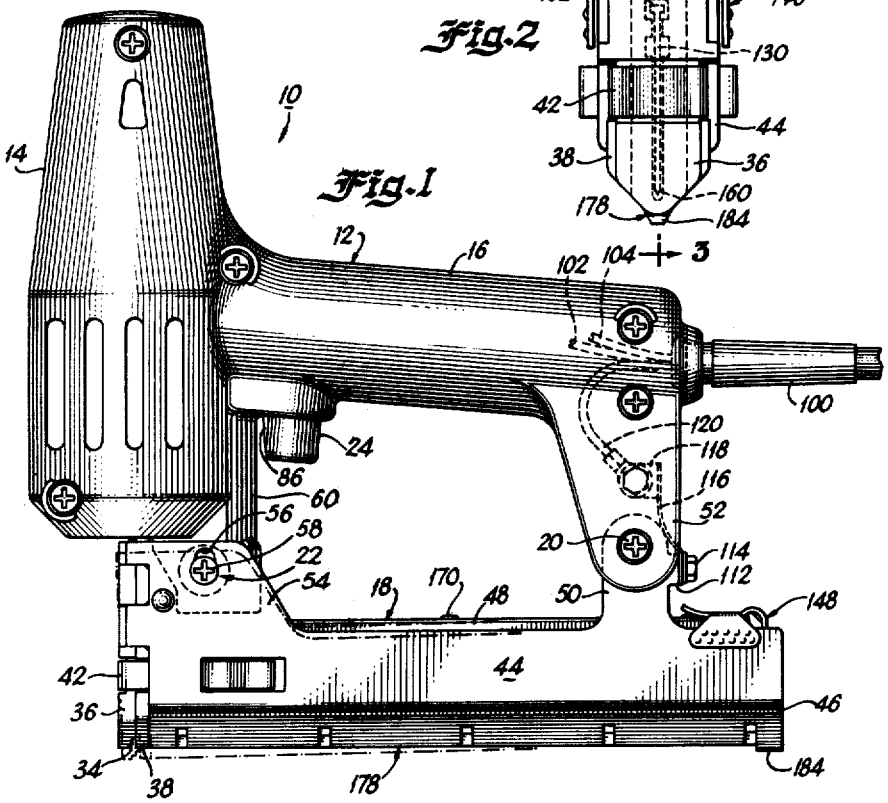
FIG. 1 is a vertical side view of the tool constructed in accordance with the principles of the present invention.

Having reference now to the drawings and initially to FIG. 1, there is illustrated an electric fastener tool designated as a whole by the reference numeral 10 and constructed in accordance with the principles of the present invention.

The tool 10 is designed for portable hand held use and includes a housing or body generally designated as 12 having a head portion 14 and a handle portion 16 that is adapted to be grasped by the hand of the user. A magazine assembly designated by the reference numeral 18 is pivotally mounted to the handle portion 16 by a pivot pin 20 and to the head portion 14 by a vertical sliding connection generally designated by the reference numeral 22. The magazine assembly 18 is adapted to contain a supply of fasteners that are to be driven upon manual actuation of the trigger in the form of the push button 24.

Figure 2:
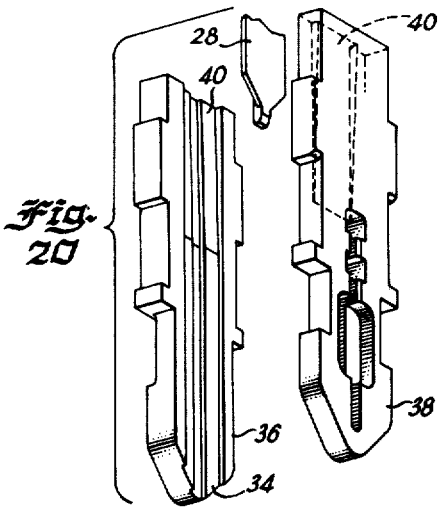
FIG. 2 is an enlarged view of the nose portion of the tool.
Figure 2:
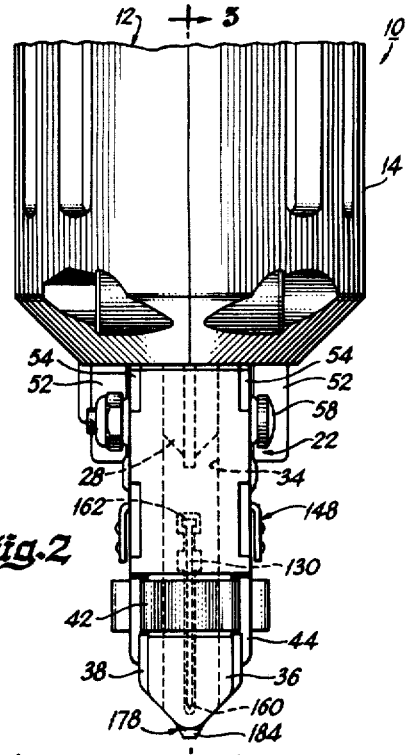
Figures 3, 14:
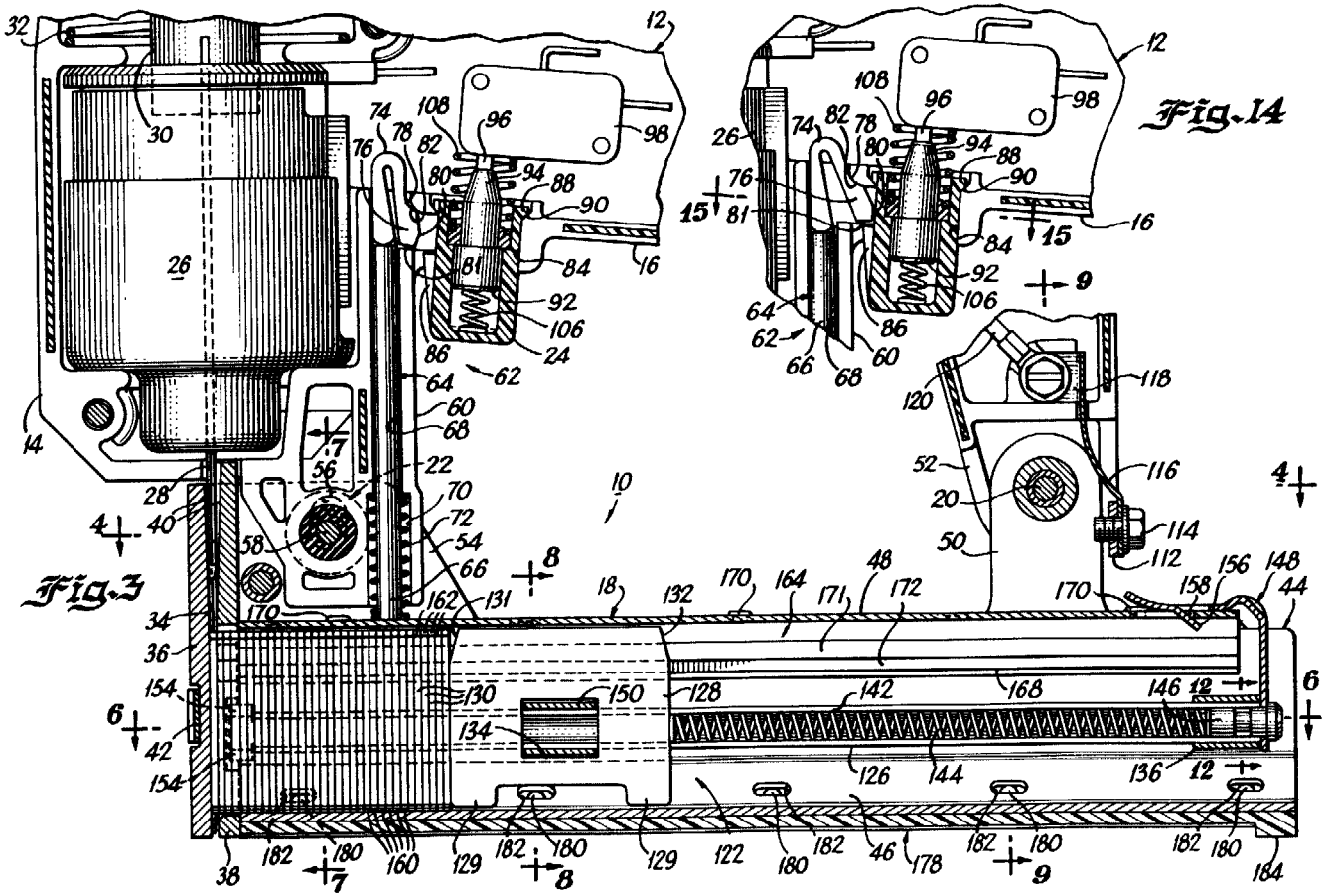
FIG. 3 is a view taken along line 3—3 of FIG. 2.
FIG. 14 is a fragmentary view of the switch plunger and safety mechanism of the present invention.
Figures 4, 5, 6:
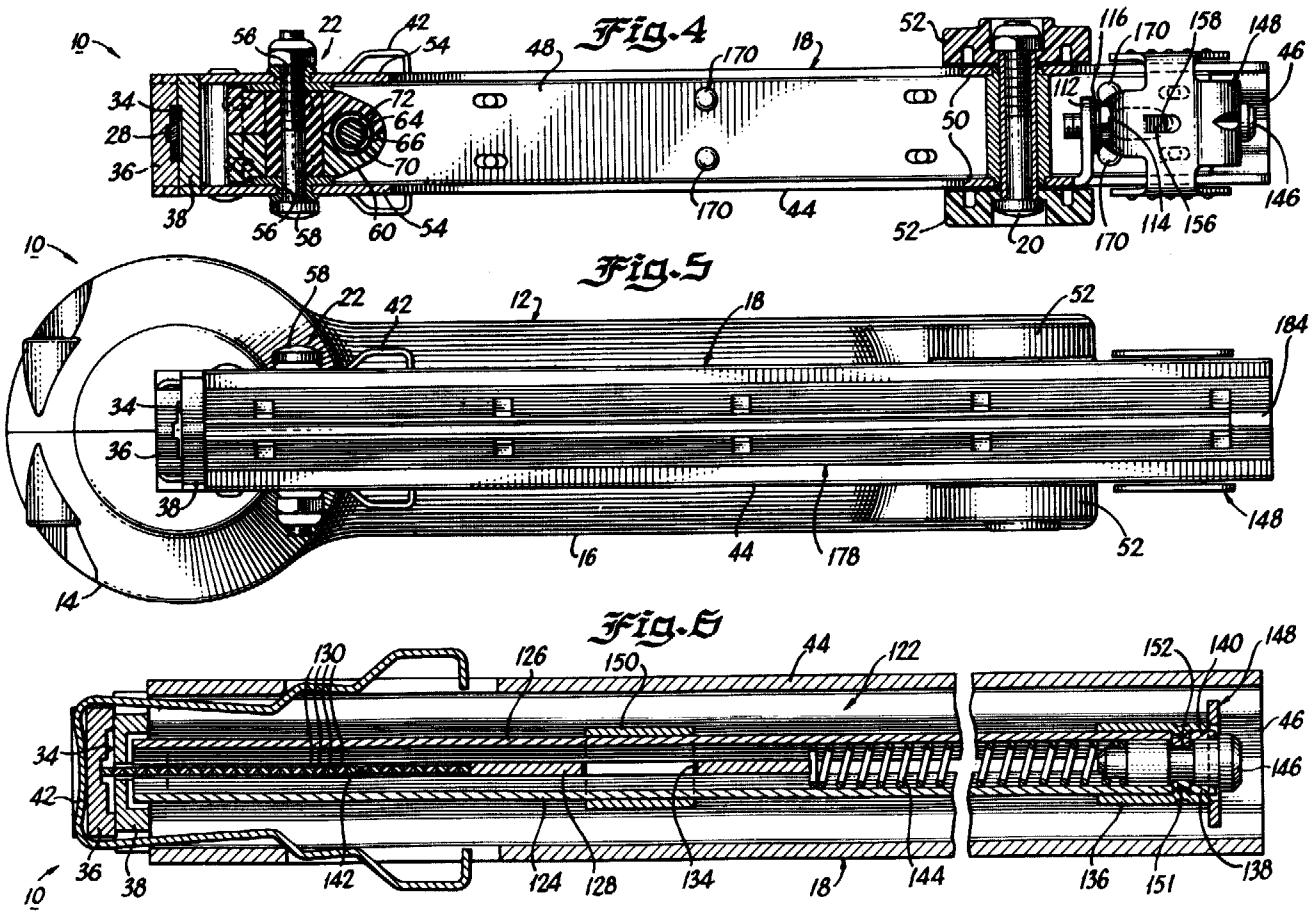
FIG. 4 is a view taken along line 4—4 of FIG. 3.
FIG. 5 is a bottom view of the tool of the present invention.
FIG. 6 is a view taken along line 6—6 in FIG. 3.

The tool 10 is actuated electrically and includes in the head portion 14 a solenoid 26 (FIG. 3). A driving blade or driver 28 is secured to the armature 30 of the solenoid 26. The armature 30 is biased in an upward position by a spring 32. The drive blade 28 is reciprocated by the solenoid 26 within a drive track 34 defined between front 36 and rear 38 nose portions (FIG. 2). As best illustrated in FIG. 3, the front 36 and rear 38 nose portions diverge at the upper end adjacent the solenoid 26 as a result of recesses 40 fabricated in the head portions 36 and 38 (FIG. 20). This is essential since the nose portions 36 and 38 are secured to the magazine assembly 18 by a spring clip 42 and are pivoted with the magazine 18. In order to prevent binding of the driver blade 28 within the drive track 34 upon pivoting of the magazine assembly 18, the recesses 40 at the upper end of the track 34 are necessary. The driver 28 in the inoperative mode of the tool, however, extends into the arrow portion of the drive track 34 such that it is not loosely held and subject to damage during transportation or handling of the tool 10.

Figure 8:
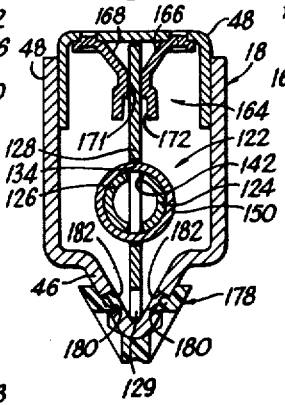
FIG. 8 is a view taken along line 8—8 in FIG. 3.

The magazine assembly 18 comprises a frame or housing 44 that includes a lower V-shaped portion 46 (FIG. 8). The top portion of the frame 44 is open and a channel 48 is mounted onto and between the sides of the frame 44. The frame 44 includes two upwardly extending connecting portions 50 that are pivotally secured to depending extensions 52 of the handle portion 16 by the pivot pin 20. The magazine frame 44 also includes upward standing flanges 54 at its forward end that include a slotted aperture 56 through which extends a fastener or pin 58. The pin 58 is mounted within an aperture defined in a depending portion 60 of the nose portion 14 so that the pin 58 is not movable relative to the housing; however, due to the slotted aperture 56 in the upstanding flange 54, the frame 44 and thus the magazine assembly 18 moves vertically relative to the housing 12. This connection at the head portion 14 in combination with the pivot connection at the pin 20 allows the magazine assembly 18 to pivot relative to the housing 12 of the tool 10. Consequently, upon placement of the tool 10 onto a workpiece, the magazine assembly 18 pivots about the pin 20 until engagement of the pin 58 with the lower end of the slotted aperture 56.

This pivoting action of the magazine assembly 18 also prevents skip off. Skip off results from the recoil of the tool 10 after firing. The recoil is often sufficient to move or "skip" the tool off the workpiece resulting in incomplete driving of the fastener into the workpiece. The pivoting action of the magazine assembly absorbs this recoil and prevents skip off. This prevention pivoting action may also be accomplished by pivoting only that portion of the assembly adjacent the drive track 34.

The pivoting movement of the magazine 18 is employed to actuate a safety mechanism generally designated by the reference numeral 62 (FIG. 3). The safety mechanism 62 includes an elongated rod 64 including a lower end 66 that abutts against the top of the channel 48 of the magazine assembly 18. The rod 64 is mounted within an elongated aperture 68 defined in the head portion 14 of the housing 12. A bottom portion 70 of the aperture 68 is enlarged to house a spring 72 surrounding the rod 64. The spring 72 abutts against the upper end of the portion 70 and against the top of the channel 48, thus providing a bias tending to pivot the magazine assembly 18 downwardly to a first position. In this first position of the magazine 18, the safety 62 prevents actuation of the tool 10 (FIG. 14).

The safety 62 includes a spring member 74 defined on rod portion 64. The spring 74 includes a cam surface 76, a curved surface surface 78, a sloped or inclined portion 80 and a bottom edge 81. The curved portion 78 engages a corresponding curved portion 82 of the housing. The housing includes an aperture 84 adjacent the portion 82 within which the trigger button 24 is slideably mounted. The trigger button 24 also includes a detent or flange 86 that engages the edge 81 of the spring portion 74 preventing actuation and a flange 88 that engages a reduced portion 90 of the aperture 84 thus preventing the button 24 from falling out of the aperture 84.

A plunger 92 is slideably mounted within the trigger button 24 and includes a nose 94 adapted to engage a plunger 96 of a microswitch 98. The microswitch 98 is connected to a power cord 100 by leads 102 and 104 (FIG. 1) which are connected to a power source providing energy for operating the tool 10. A first spring 106 is positioned within the trigger button 22 and beneath the plunger 92 tending to bias the plunger 92 into engagement with the plunger 96 of the microswitch 98. A second spring 108 surrounds the plunger 92 and engages the microswitch housing 98 tending to bias the plunger 92 and the trigger button 24 away from the microswitch 98. The spring 108 is larger than the spring 94 such that when not engaged, the trigger button 24 and the plunger 98 are biased by the spring 108 out of engagement with the plunger 96 of the microswitch 98.

In order to energize the tool 10, the operator must first place the magazine 18 against the workpiece thus pivoting the magazine 18 about the pivot pin 20 and moving the rod 64 and spring 74 upward. This causes the cam surface 78 to engage the curved surface 82 bending the spring 74 and causing the surface 81 to move out of engagement with the flange 86. The operator of the tool 10 may then depress the trigger button 24 contacting the plunger 96 and energizing the switch 98 to drive the blade 28 through a driving stroke.

As an added safety feature and to ground the magazine 18, the magazine housing 44 includes a ground tab 112 that is electrically connected by means of a fastener 114 to a grounding clip 116. The grounding clip 116 is flexible and includes a flange 118 that is coupled to a ground wire 120 leading from the power cord 100 (FIG. 3). Accordingly, upon pivoting of the magazine assembly 18, the grounding clip 116 flexes thus maintaining the grounding connection desired.

Figures 10, 12, 13, 15, 16:
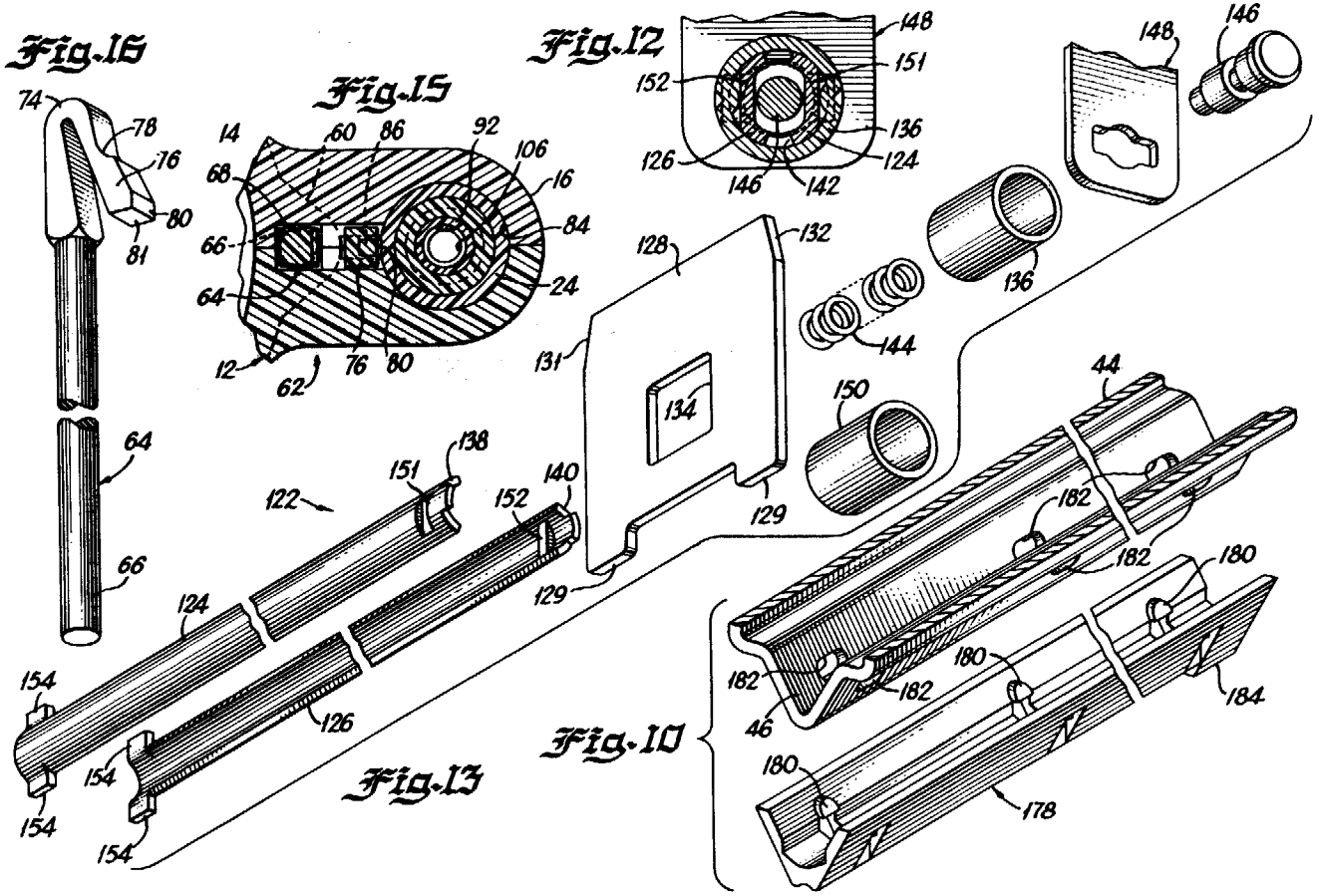
FIG. 10 is a partial view of a portion of the magazine housing and a shoe.
FIG. 12 is a view taken along line 12—12 of FIG. 3.
FIG. 13 is an exploded view of the pusher assembly.
FIG. 15 is a view taken along lines 15—15 in FIG. 14.
FIG. 16 is a perspective fragmentary view of the safety member of the present invention.

Turning now to the magazine assembly 18, there is included a novel pusher assembly generally designated by the reference numeral 122 (FIG. 13). The pusher assembly 122 includes first 124 and second 126 identical elongated tubular members that in a preferred embodiment illustrated are half or bifurcated portions of an elongated tube. The tubular portions 124 and 126 serve as a guide for a pusher 128 and fasteners 130 that are mounted within the magazine assembly 18. The pusher 128 is of a rectangular configuration including legs 129 and inclined surfaces 130 and 132. The pusher 128 also includes a rectangular aperture 134 that allows the pusher 128 to be slidingly coupled to the guides 124 and 126.

To assemble the pusher assembly 122, a first pusher sleeve 136 is passed over and around first ends 138 and 140 of the guides 124 and 126, respectively, and secured in a manner such that the guides 124 and 126 are spaced slightly apart to define a gap 142 therebetween. (See, for example, FIGS. 17 and 18). A spring 144 is positioned within and between the guides 124 and 126 with an end engaging a stud 146 that serves to connect a pusher lock 148 to the ends 138 and 140 of the guides 124 and 126 and to maintain the guides 124 and 126 in spaced relationship. A pusher lock 148 is then secured within slots 151 and 152 fabricated in the guides 124 and 126, respectively.

The pusher 128 is mounted within the gap 142 and is biased by the spring 144 away from the stud 146. To mount the pusher 128 within the gap 142, a second pusher sleeve 150 passes through the aperture 134 and encircles the guides 124 and 126 thus joining them together (see, for example, FIG. 3). The guides 124 and 126 include flanges 154 on the ends thereof that are engaged by the pusher sleeve 150 thus preventing the pusher 128 from being biased by the spring 148 beyond the length of the guides 124 and 126.

The pusher assembly 122 is positioned within the frame 44 of the magazine assembly 18 and is supported at one end by the pusher lock 148 that includes a clip 156 that is removably attached in an aperture 158 fabricated in the channel 48. The pusher assembly 122 once mounted in the magazine assembly 18 is supported at the other end by the pusher 128 on the leg portions 129 that engage V-shaped section 46 of the frame 44.

Figure 7:
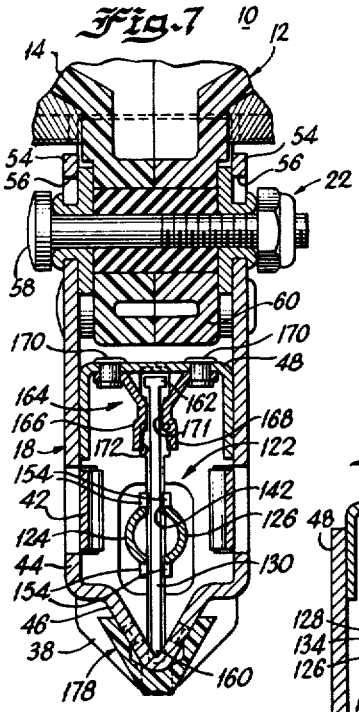
FIG. 7 is a view taken along line 7—7 in FIG. 3.
Figure 9:
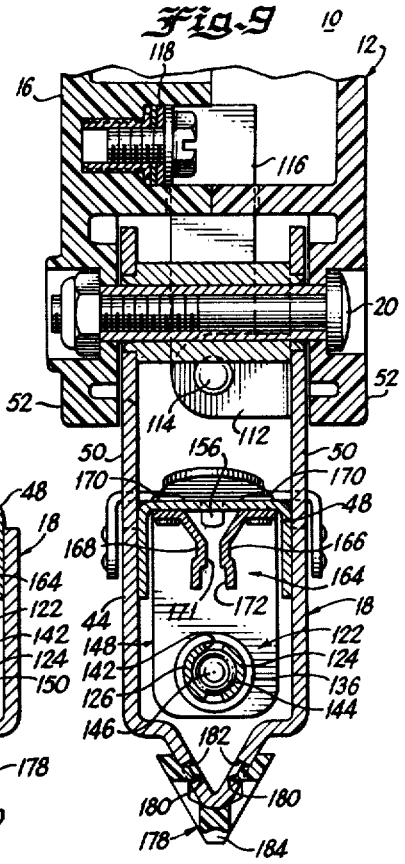
FIG. 9 is a view taken along line 9—9 in FIG. 3.
Figure 17:
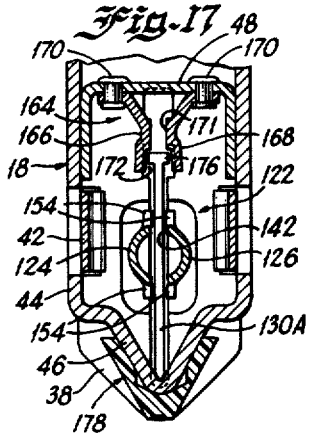
FIG. 17 is a fragmentary cross-sectional view of the magazine assembly of the present invention.
Figure 18:
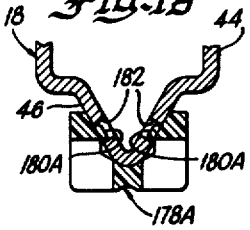
FIG. 18 is a fragmentary view of the magazine housing and shoe attached thereto.
Figure 19:
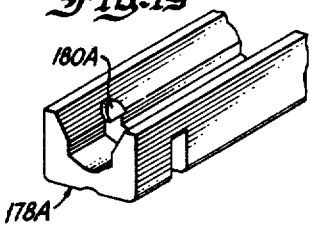
FIG. 19 is a partial view of another embodiment of a shoe intended to be attached to the magazine housing.

Before operating the tool 10, a stick of fasteners 130 is positioned within in the magazine 18 in a manner such that the ends 160 of the fasteners are engaged and are supported by the apex of the V-section 46 of the frame 44 (FIG. 7). The magazine 18 may hold fasteners of two different sizes through the use of a track generally designated by the reference numeral 164. The track 164 is defined by first 166 and second 168 guide members that are secured to the channel 48 by a plurality of rivets 170. Upon being secured to the channel 48, the guides 166 and 168 define a reduced portion 171 and an enlarged portion 172. If long fasteners 130 are employed (see, for example, FIG. 7), the head 162 of the fastener 130 extends above and is guided by the reduced portion 171 of the track 164. If a shorter fastener such as 130A in FIG. 17 is desired to be driven by the tool 10, the head 176 of the fastener 130A is guided by the enlarged portion 172.

The fastener 130 and 130A are fed through the drive track 134 by the pusher 128. Once the last fastener 130 or 130A has been driven, the front edge of the pusher 28 is moved into the drive track 34 by the spring 144. If the tool 10 is fired, the driver 28 will engage one of the leading inclined surfaces 130 or 132 and this engagement moves the pusher 128 out of the drive track 34 against the bias of the spring 144 thus preventing damage to the pusher 128. Once the operator of the tool 10 notices that no further fasteners 130 or 130A are being driven by the tool, operation of the tool 10 can be terminated and a new stick of fasteners 130 or 130A may be inserted into the magazine assembly 18.

The tool 10 may be used on grooved workpieces such as panelling in which it is desired to drive the fasteners into the grooves of the panelling. This is the reason that frame 44 of the magazine assembly 18 includes the V-shaped section 46. The nose of the tool is also V-shaped at its lower end in order to be inserted within the grooves of the panelling. Due to the fact that the workpiece such as panelling may be of a softer material than others, it is often undesirable to allow the driver blade 128 to engage the workpiece since it would leave a dent. Accordingly, a shoe generally designated by the reference numeral 178 is included. The shoe 178 is of the same general configuration as the magazine frame 44 and is intended to be releaseably secured to the frame 44 through the use of detents 180 fabricated on the inner peripheral surface of the shoe 178 that are inserted into corresponding apertures 182 fabricated in the frame 44. The shoe 178 is made of resilient material, thus allowing a spring like connection once the detents 180 are snapped into the apertures 180.

Figure 11:
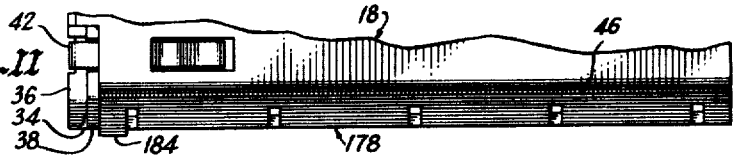
FIG. 11 is a partial view of the shoe secured to the magazine housing.

To prevent damage to a workpiece, the shoe 178 includes a raised portion 184 (see, for example, FIGS. 1 and 11). The shoe 178 may be secured to the frame 44 with the raised portion 184 adjacent to the nose (FIG. 11). In this position, the raised portion 184 engages the workpiece maintaining the nose portions 36 and 38 spaced slightly above the workpiece such that the driver 28 does not engage the workpiece upon completion of its full stroke, thus avoiding unslightly dents in the workpiece.

If it is desired to use the tool 10 on a flat ungrooved workpiece, another shoe such as the shoe 178A may be employed. This shoe 178A includes an inner peripheral V-shaped configuration conforming to the frame 44 and detents 180A that are to be inserted into the apertures 182 in the frame 44; however, the lower surface of the shoe 178 is flat thus allowing the tool 10 to be placed on top of a flat workpiece.

Obviously, many modifications and variations of the present invention are possible in light of the above teachings. Thus, it is to be understood that, within the scope of the appended claims, the invention may be practiced other than an specifically described above.

What is claimed and desired to be secured by Letters Patent of the United States is:

1. In a fastener driving tool of the type including a housing defining a handle portion and a nose portion, a drive track defined in said nose portion, a driver blade mounted in said track and means for driving said blade, the improvement comprising a magazine assembly including a housing and a fastener support member, said fastener support member defined by first and second identical guide members spaced apart and of a configuration wherein each defines first and second fastener engagement portions, said first fastener engagement portions define a first gap between said first and second guide members of a narrower width than a second gap defined by said second fastener engagement portions between said first and second guide members and vertically below said first gap, said first fastener engagement portions adapted to engage fasteners of a first size and said second fastener engagement portions adapted to engage fasteners of a second size, said first and second fastener engagement portions further define a section spaced vertically above said first fastener engagement portions for surrounding the head of said fasteners of said first size.

2. The tool claimed in claim 1 wherein said magazine assembly further includes a bottom secured to said housing wherein fasteners to be driven by said driver blade stand thereon.

3. The tool claimed in claim 1 further comprising a shoe removably attached to the outer periphery of said magazine housing for engaging a workpiece, said shoe including an inner periphery complementary to the configuration of the outer periphery of said frame to allow securement of said engagement member to said frame, said engagement member including an outer peripheral workpiece engaging surface of a configuration complementary to the surface of a selected workpiece.

4. In an electric tool for driving fasteners into a workpiece including a housing defining a nose portion and a handle portion, a fastener driving blade, and means for driving said blade, the improvement comprising a magazine assembly including a frame connected to said housing, and a fastener pusher assembly mounted in said frame, said pusher assembly including a bifurcated tube, means for holding said bifurcated tube together to define a gap therein, attachment means for removably attaching said tube to said magazine, a fastener pusher slideably secured to said tube and positioned in said gap, and biasing means mounted in said tube for biasing said pusher to advance said fasteners, said magazine assembly further includes a fastener track for supporting and guiding said fasteners, said track including a reduced portion for engaging the shank of a fastener of a first size and an enlarged portion spaced vertically below said reduced portion for engaging the head of a fastener of a second size shorter than said first size.

5. The tool set forth in claim 4 wherein said frame includes a lower V-shaped portion spaced a predetermined distance below said fastener track whereby a fastener engaged by either of said reduced portion or said enlarged portion of said fastener track is supported thereon.

6. The tool set forth in claim 5 further comprising a support strip removably secured to said V-shaped portion of said magazine assembly and adapted to engage said workpiece, said strip including a raised portion that upon being secured to said frame adjacent said nose portion, elevates said nose portion relative to said workpiece, said strip including a first end with said raised portion thereon and a second end, said strip including an inner periphery complementary to the configuration of said V-shaped portion of said magazine, and means for securing either said first end or said second end adjacent said nose portion.

7. A pusher assembly for use to advance headed fasteners in a magazine assembly including a bottom end of the type used in fastener driving tools comprising:

a first guide member defined by a predetermined portion of an elongated tube, a second guide member defined by a second predetermined portion of the elongated tube, first means for securing said first and second guide means to said magazine assembly and for joining said first and second portions in spaced relationship to define a gap therebetween, a pusher, second means for slideably mounting said pusher on said first and second guide members and in said gap and for joining said first and second guide members in spaced relationship, said pusher including support portions, said second means mounting said pusher in a predetermined position wherein said support portions engage said bottom of said magazine assembly thereby supporting said first and second guide members, and means for biasing said pusher and said second means from one end of said first and second guide members to another end of said first and second guide members.

8. The pusher assembly set forth in claim 7 wherein said first and second guide members each comprises approximately one-half of said elongated tube.

9. The pusher assembly set forth in claim 7 wherein said biasing means comprises a spring mounted within said elongated tube.

10. The pusher assembly claimed in claim 7 wherein said magazine assembly includes an opening top housing, a channel member secured to and covering said top of channel member, said housing including a V-shaped bottom portion, a fastener track defined by first and second identical track members secured to said channel member, said track defining a reduced portion of a transverse dimension less than the transverse dimension of the heads of said fasteners and an enlarged portion of a transverse dimension approximately equal to the transverse dimension of said heads.

11. The pusher assembly claimed in claim 10 wherein said magazine assembly is adapted to hold fasteners with said heads above and guided by said reduced portion of said track and the tips of said fasteners engaging and being supported by said bottom portion.

12. The pusher assembly claimed in claim 10 wherein said magazine assembly adapted is to hold fasteners with said heads positioned and guided by said enlarged portion of said track and the tips of said fasteners engaging and being supported by said bottom portion.

13. The pusher assembly claimed in claim 10 further comprising a shoe removably secured to said bottom portion of said magazine assembly, said shoe being generally V-shaped and including first and second ends, one of said first and second ends including a raised portion.

14. The pusher assembly claimed in claim 10 further comprising a shoe removably secured to said bottom portion of said magazine assembly, said shoe being of a truncated configuration defining a flat workpiece engaging surface, said shoe including first and second ends, one of said first and second ends including a raised portion.

15. In a fastener driving tool of the type including a housing defining a handle and nose portions, a drive track defined in said housing, a driver blade reciprocally mounted in said drive track and a magazine assembly mounted on said housing for feeding fasteners to said drive track, said magazine assembly including a frame, the improvement comprising a workpiece engagement member removably attached to said frame, said engagement member including an inner periphery of a configuration complementary to the configuration of the outer periphery of said frame to allow securement of said engagement member to said frame in reversible positions to align first and second ends of said engagement member adjacent said drive track, said engagement member including an outer peripheral workpiece engaging surface of a configuration complementary to the surface of a selected workpiece, said engagement member further including a raised portion on said outer peripheral workpiece engaging surface in the vicinity of one of said first or second ends of said engagement member for elevating said nose portion above said workpiece when said first or second end with said raised portion is positioned adjacent said drive track to prevent damage to said workpiece by said blade, said raised portion being of a size and configuration to allow placement of said nose portion on said workpiece when said work engagement member is in the reverse position with said raised portion distant from said drive track.

16. The tool set forth in claim 15 wherein said workpiece engaging surface of said engagement member is flat.

17. The tool set forth in claim 15 wherein said workpiece engaging surface is V-shaped.

* * * * *